PTU33 XR 4,460,623

United States Patent [19]
Levinson

[11] Patent Number: 4,460,623
[45] Date of Patent: Jul. 17, 1984

[54] METHOD OF VARISTOR CAPACITANCE REDUCTION BY BORON DIFFUSION

[75] Inventor: Lionel M. Levinson, Schenectady, N.Y.

[73] Assignee: General Electric Company, Schenectady, N.Y.

[21] Appl. No.: 317,695

[22] Filed: Nov. 2, 1981

[51] Int. Cl.³ ..... H01C 7/12; H01C 17/30
[52] U.S. Cl. ..... 427/101; 427/126.2; 427/299; 427/331; 427/355; 338/21
[58] Field of Search ..... 427/101, 126.2, 299, 427/355, 331; 338/21

[56] References Cited

U.S. PATENT DOCUMENTS

| | | | |
|---|---|---|---|
| 3,903,494 | 9/1975 | May | 427/101 |
| 4,046,847 | 9/1977 | Kresge | 338/21 |
| 4,060,661 | 11/1977 | Takami et al. | 427/101 |
| 4,172,922 | 10/1979 | Merz et al. | 427/101 |

FOREIGN PATENT DOCUMENTS

| | | | |
|---|---|---|---|
| 2832735 | 2/1979 | Fed. Rep. of Germany | 338/21 |

OTHER PUBLICATIONS

Selim et al., J. App. Phys. 51(1), Jan. 1980.

*Primary Examiner*—Norman Morgenstern
*Assistant Examiner*—Richard Bueker
*Attorney, Agent, or Firm*—Robert J. Jarvis; James C. Davis, Jr.; Marvin Snyder

[57] ABSTRACT

Diffusing boron-containing glass, such as bismuth borosilicate glass, into conventional sintered zinc oxide based varistor material reduces varistor material intrinsic capacitance. In the method, a layer of glass powder is screen-printed, painted, or otherwise applied to the varistor material surface. Upon firing, a portion of the glass diffuses into the material, while the remainder creates an insulating layer on the varistor material surface which may be removed by grinding. The varistor material may then be annealed to restore varistor electrical properties which may have been degraded by mechanical damage caused by the grinding. Device electrodes are attached by conventional means.

5 Claims, 1 Drawing Figure

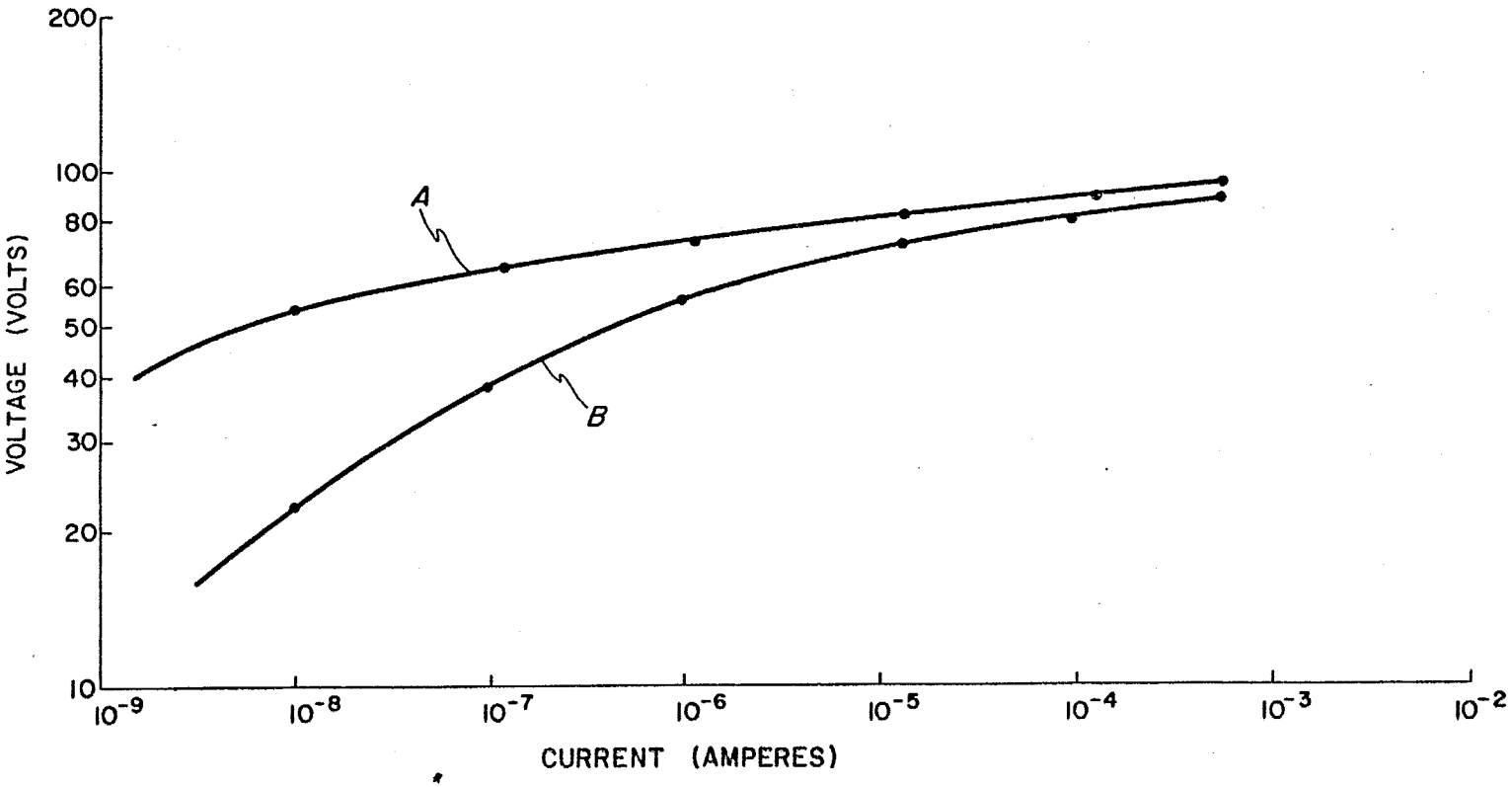
VOLTAGE (VOLTS)
200
100
80
60
50
40
30
20
10
$10^{-9}$
$10^{-8}$
$10^{-7}$
$10^{-6}$
$10^{-5}$
$10^{-4}$
$10^{-3}$
$10^{-2}$
CURRENT (AMPERES)
A
B

METHOD OF VARISTOR CAPACITANCE REDUCTION BY BORON DIFFUSION

BACKGROUND OF THE INVENTION

This invention relates to metal oxide varistors and, in particular, to a methd of reducing intrinsic capacitance of zinc oxide based varistor material.

In general, a metal oxide varistor comprises a zinc oxide (ZnO) based ceramic semiconductor device with a highly nonlinear current-voltage relationship which may be represented by the equation $I=(V/C)^{\alpha}$, where V is the voltage between two points separated by the varistor material, I is the current flowing between the points, C is a constant, and $\alpha$ is a measure of device nonlinearity. If $\alpha=1$, the device exhibits ohmic properties. For values of $\alpha$ greater than 1 (typically 20–50 or more for ZnO based varistors), the voltage-current characteristics are similar to those exhibited by back-to-back connected Zener diodes. Varistors, however, have much greater voltage, current, and energy-handling capabilities. If the voltage applied to the varistor is less than the varistor breakdown voltage, only a small leakage current will flow between the electrodes and the device acts essentially as an insulator having a resistance of many megohms. However, if the applied voltage is greater than the varistor breakdown voltage, the varistor resistance drops to low values, permitting large currents to flow through the varistor. Under varistor breakdown conditions, the current through the varistor varies greatly for small changes in applied voltage so that the voltage across the varistor is effectively limited to a narrow range of values. The voltage limiting or clamping action is enhanced at higher values of $\alpha$.

Metal oxide varistors have been widely employed as surge arresters for protecting electrical equipment from transients on AC power lines caused by lightning strikes or switching of electrical apparatus. Such applications require the use of varistors having breakdown voltages slightly greater than the maximum input voltage of the system to be protected. Thus, for example, a typical system powered from 170 volts peak voltage (120 volts rms) AC power mains would require the use of a varistor having a breakdown voltage somewhat greater than 170 volts.

Varistor device behavior may be approximately modeled by a variable resistor in parallel with a capacitor. The parasitic capacitance modeled by the capacitor is an intrinsic property associated with the particular varistor composition, and is generally undesirable as it may adversely affect varistor performance in surge-protective or switching applications, for example. In typical surge-arrester applications, the varistor is subjected to a continuously applied voltage. Although the applied voltage is lower than the varistor breakdown voltage, an undesirable current, due predominantly to the parasitic capacitance, flows through the varistor. In high frequency circuits, this current flow may be large enough to interfere with normal operation of the circuit.

Varistor devices may also be used as switching elements for multiplexing, for example, liquid crystal displays. In such applications, the parasitic capacitance is also a problem, since it appears in series with the the capacitance of the liquid crystal material, forming a capacitive voltage divider. A lower electric field than would otherwise be available is thus used to maintain the liquid crystal material in its active state. Additionally, if the varistor capacitance is too high, nonselected elements in the liquid crystal array may be inadvertently activated by pulses applied to the display. A more detailed description of multiplexing liquid crystal displays using varistors appears in U.S. Pat. No. 4,223,603 issued to D. E. Castleberry and in application Ser. No. 233,423 now abandoned, filed Apr. 11, 1981 by L. M. Levinson, both assigned to the same assignee as the present invention.

From the foregoing the importance and desirability of reducing varistor capacitance is apparent. U.S. Pat. No. 4,276,578, issued to L. M. Levinson and assigned to same assignee as the present invention, discloses the use of antimony oxide ($Sb_2O_3$) in the varistor for the purpose of decreasing varistor intrinsic capacitance. The present invention provides a method for reducing intrinsic varistor capacitance by diffusion of boron-containing glass into conventional sintered zinc oxide varistor material.

SUMMARY OF THE INVENTION

In accordance with the present invention, a zinc oxide based varistor exhibiting a reduced intrinsic capacitance is fabricated by diffusing at elevated temperature boron-containing glass into a conventional zinc oxide based varistor material. A layer of fine glass powder is applied to the varistor material surface. The glass is then fired in air at a temperature of between 500° C. and 1200° C.

A fraction of the glass diffuses into the varistor material while the remainder (if excess glass has been used or if the glass is fired for a relatively short time) forms an insulative surface layer which may be removed by grinding. Prior to applying device electrodes by conventional methods, the varistor material may be annealed at a temperature of between 600° C. and 1000° C. to restore varistor electrical properties which may have been degraded by mechanical damage caused by the grinding. The annealing step may be omitted if grinding of the insulating surface layer is unnecessary or if varistor performance is otherwise acceptable. In applications requiring a flat varistor slab, such as in liquid crystal display multiplexing, the varistor material surface may be ground flat prior to applying the glass powder thereto.

It is an object of the invention to provide a ZnO based varistor exhibiting reduced intrinsic capacitance.

It is another object of the invention to provide a method of reducing the intrinsic capacitance of ZnO based varistor material.

It is still another object of the invention to provide a method for reducing ZnO varistor intrinsic capacitance by diffusing boron-containing glass into the varistor material.

BRIEF DESCRIPTION OF THE DRAWING

The features of the invention believed to be novel are set forth with particularly in the appended claims. The invention itself, however, both as to its organization and method of operation, together with further objects and advantages thereof, may best be understood by reference to the following description taken in conjunction with the accompanying drawing in which the single FIGURE depicts a voltage-current characteristic curve of a metal oxide varistor produced in accordance with the present invention. The FIGURE also depicts a similar characteristic curve of a conventional ZnO based varistor.

DETAILED DESCRIPTION OF THE INVENTION

The invention constitutes a method for reducing varistor intrinsic capacitance by diffusion of boron-containing glass into conventional sintered zinc oxide based varistor material. The varistor material may conveniently comprise any of the standard constituents employed in fabricating metal oxide varistors by conventional methods. Typically, such varistors have zinc oxide (ZnO) as the primary constituent (typically, 90 mole percent or more) and include smaller quantities of other metal oxide additives, such as bismuth oxide ($Bi_2O_3$), cobalt oxide ($Co_2O_3$), chromium oxide ($Cr_2O_3$) as well as other additives which may include additional metal oxides. Examples of such additives include manganese oxide ($MnO_2$), antimony trioxide ($Sb_2O_3$), silicon dioxide ($SiO_2$), nickel oxide (NiO), magnesium oxide (MgO), aluminum nitrate ($Al(NO_3)_3.9(H_2O)$), tin oxide ($SnO_2$), titanium oxide ($TiO_2$), nickel fluoride ($NiF_2$), barium carbonate ($BaCO_3$), and boric acid ($H_3BO_3$). The list of additives is not intended to be exhaustive, nor, generally are all of the above-enumerated materials employed in a single varistor composition. By way of example, and not limitation, a varistor material suitable for practicing the invention may comprise 1.0 mole percent each of $Bi_2O_3$ and NiO, 0.5 mole percent each of $Co_2O_3$, $MnO_2$ and $Cr_2O_3$, 5 mole percent $Sb_2O_3$, 0.1 mole percent each of $SiO_2$ and $BaCO_3$, 0.2 mole percent of $H_3BO_3$, the remainder being ZnO.

In practicing the invention, a boron-containing glass is ground into a fine powder and then mixed with a suitable inert organic or inorganic carrier material such as pine oil and ethyl cellulose to a consistency suitable for application to the varistor material. The powdered glass mixture may be applied to the varistor by, for example, screen printing, brushing, or dipping. Typical ground glass layer thicknesses applied to the varistor are between 0.0005 and 0.01 inch. A suitable boron-containing glass is bismuth borosilicate glass composed of approximately 60 weight percent $Bi_2O_3$, 20 weight percent $B_2O_3$, 10 weight percent $SiO_2$, and 10 weight percent silver oxide ($Ag_2O$). To allow application of additional thick films as required, including multiple glass layers, the earlier applied glass layers may be dried.

Following application of the glass to the varistor material, the glass is fired at a temperature of between about 500° C. and 1200° C. in air for a time ranging from a few minutes up to several hours. The degree of penetration of boron, believed to be the glass constituent responsible for reducing varistor capacitance, into the varistor material is determined by the duration and temperature of the firing step. For example, heating a varistor material at 800° C. for approximately one hour results in a boron diffusion depth of approximately one millimeter. If sufficient time is allowed, boron can be made to completely penetrate the varistor.

Upon completion of the firing step, depending on the thickness of the glass layer and the temperature and duration of the firing step, the glass may have completely diffused into the varistor material. If a large quantity of glass is applied to the varistor and the diffusion step is relatively short or the temperature is relatively low, an insulating glass layer will form on the varistor material surface. The insulative layer must be removed by grinding, for example, to expose the varistor material surface. In this case it may also be desirable to anneal the ground varistor in air at a temperature of between 600° C. and 1000° C. to restore varistor electrical properties (such as leakage current) which may have been degraded by mechanical damage caused by grinding. The duration of the annealing step is temperature dependent. Generally, annealing the varistor material for one-half hour to several hours is sufficient. The annealing of a varistor to restore mechanically degraded varistor electrical properties is described and claimed in pending application Ser. No. 059,520, now abandoned, filed July 23, 1979 by H. R. Philipp, and assigned to the same assignee as the present invention.

Electrodes may be formed on the finished varistor material by any of the well-known techniques such as, for example, chemical vapor deposition or plasma or flame-spraying. A technique which is particularly economical and easily automated involves screen printing. In order to bond the screen-printed electrodes to the varistor material, the varistor may be heated in air at a temperature of between approximately 500° C. and 850° C. for a period of up to one hour. A suitable material for screen printing the electrodes may comprise powdered silver combined with a carrier material. An example of a material useful for screen printing electrodes is a silver-based thick-film composition manufactured by E. I. duPont deNemours and Company (Wilmington, Delaware) and identified as No. 7713.

In applications where attaching electrodes to the opposite sides of the varistor material is inconvenient, impractical, or where it is desired to control electrode separation, surface electrodes may be attached adjacent to one another on the same side of the varistor material. An example of such an application is in varistor multiplexed liquid crystal displays. In this application, a flat varistor surface is desirable for attaching the electrodes. To obtain the flat surface, the varistor material may be ground flat prior to applying the glass layer.

The drawing depicts voltage-current characteristic curves designated A and B exhibited by a ZnO varistor having the aforedescribed exemplary composition and by an identical ZnO varistor treated in accordance with the method of the present invention, respectively. The varistor material for both devices tested was obtained from the same varistor material slab. Both varistor devices were treated identically, except that the device exhibiting the B voltage-current characteristic was annealed at 800° C. for one hour to cause diffusion from a screen-printed layer of bismuth borosilicate glass having the aforedescribed composition. Each device was provided with aluminum surface electrodes formed by evaporation and spaced 10 millimeters apart. The capacitance for each varistor was measured at a frequency of 1 KHz. The capacitance of the untreated varistor (Curve A) was found to be 17.2 picofarads, while the capacitance of the varistor material having boron-glass diffused therein (Curve B) in accordance with the invention was measured to be 13.3 picofarads. It is seen that diffusion of boron-containing glass into varistor material results in a decrease of varistor intrinsic capacitance of about 20 percent.

The decrease in intrinsic varistor capacitance is believed due to diffusion of boron into the varistor material at high temperature. Boron has a smaller ionic radius than bismuth, silicon, or silver (the other constituents of bismuth borosilicate glass) and, therefore, would tend to diffuse into varistor material at a faster rate. It is thus likely that at the end of the firing step a greater quantity of boron would diffuse to a greater depth than any of the other glass constituents. Although boron is not an essential constituent of conventional varistors, small quantities are frequently added to the varistor powder prior to sintering to enhance varistor stability or decrease leakage current. The intrinsic capacitance decreasing effect of diffusing additional boron into sintered varistor material in accordance with the invention is, however, observed in varistors sintered from raw materials including boron.

Although bismuth borosilicate glass has been described as useful in practicing the invention, it is believed that other boron-containing materials may also be used. In particular, any boron compound stable in an oxidizing atmosphere can be used to coat the varistor to provide a boron diffusion source. Additionally, gaseous boron transport could be utilized to supply the boron.

It is seen from the foregoing that the present invention provides ZnO based varistor material having a reduced intrinsic capacitance. Such varistors are produced by diffusing boron-containing glass such as bismuth borosilicate glass into sintered varistor material.

While certain preferred features of the invention have been shown by way of illustration, many modifications and changes will occur to those skilled in the art. It is, therefore, to be understood that the appended claims are intended to cover all such modifications and changes as fall within the true spirit of the invention.

The invention claimed is:

1. A method of decreasing the intrinsic capacitance of sintered ZnO based varistor material comprising the steps of:

applying a boron-containing glass which is substantially free of electrically conductive material to a surface of said sintered ZnO based varistor material;

heating said ZnO based varistor material having said boron-containing glass applied thereto at a temperature of between about 500° C. and about 1200° C. to diffuse a sufficient amount of said boron-containing glass into said ZnO based varistor material to effect a decrease in the intrinsic capacitance thereof; and removing undiffused boron-containing glass from said surface, after said heating step.

2. The method of claim 1 wherein, prior to said step of applying said powdered boron-containing glass, said varistor material surface is ground flat.

3. The method of claim 2 wherein said glass comprises bismuth borosilicate glass.

4. The method of claim 3 wherein said ZnO varistor comprises about 1.0 mole percent each of $Bi_2O_3$ and NiO, about 0.5 mole percent each of $Co_2O_3$, $MnO_2$, and $Cr_2O_3$, about 0.1 mole percent each of $SiO_2$ and $BaCO_3$, about 0.2 mole percent $H_3BO_3$, about 5 mole percent $Sb_2O_3$, the remainder being ZnO.

5. A method of decreasing the intrinsic capacitance of sintered ZnO based varistor material comprising the steps of:

applying a boron-containing compound which is substantially free of electrically conductive material to a surface of said sintered ZnO based material;

heating said sintered ZnO based varistor material having said boron-containing compound applied thereto at a temperature of between about 500° C. and about 1200° C. to diffuse sufficient boron from said compound into said sintered ZnO based material to a sufficient predetermined depth therein to effect a decrease in the intrinsic capacitance thereof; and removing undiffused boron-containing compound from said surface, after said heating step.

* * * * *